US011381023B2

(12) United States Patent
Chen

(10) Patent No.: US 11,381,023 B2
(45) Date of Patent: Jul. 5, 2022

(54) ELECTRICAL CONNECTOR AND METHOD THEREOF MAKING THE SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Chao-Chieh Chen, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 12 days.

(21) Appl. No.: 17/120,853

(22) Filed: Dec. 14, 2020

(65) Prior Publication Data

US 2021/0184384 A1 Jun. 17, 2021

(30) Foreign Application Priority Data

Dec. 13, 2019 (CN) ..... 201911280203.X

(51) Int. Cl.
*H01R 13/41* (2006.01)
*H01R 13/24* (2006.01)
(Continued)

(52) U.S. Cl.
CPC ..... *H01R 13/2407* (2013.01); *H01R 13/2464* (2013.01); *H01R 13/405* (2013.01); *H01R 43/24* (2013.01)

(58) Field of Classification Search
CPC ..... H01R 13/2407; H01R 13/405; H01R 13/2435
(Continued)

(56) References Cited

U.S. PATENT DOCUMENTS 4,394,795 A * 7/1983 Goss ..... H01R 43/205 439/62
6,764,357 B2 * 7/2004 Wu ..... H01R 43/20 439/885
(Continued)

FOREIGN PATENT DOCUMENTS

CN 102324647 B 6/2013

*Primary Examiner* — Neil Abrams
(74) *Attorney, Agent, or Firm* — Ming Chieh Chang; Wei Te Chung

(57) ABSTRACT

An electrical connector includes an insulative housing, and plural rows of contact modules therein. Each contact module includes plural contacts integrally formed within an insulator/wafter which extends in a longitudinal direction. In each contact module, each contact includes a main body with opposite contacting arms on upper and lower sections wherein the contacts in the same contact carrier are originally linked with the neighboring contacts around lateral sides of the main body for insert-molding consideration, and the corresponding linking sections are removed for disconnecting the neighboring the contacts after insert-molding to form the final complete contact module. Each contacting arm forms a hole with two spaced beams by two sides of the hole. The contact may further include a holding tab exposed in the hole so as to allow a gripping tool to be engaged thereon for assembling the contact module into the channel of the housing.

20 Claims, 15 Drawing Sheets

(51) Int. Cl.
*H01R 43/24* (2006.01)
*H01R 13/405* (2006.01)

(58) Field of Classification Search
USPC ..... 439/862
See application file for complete search history.

(56) References Cited

U.S. PATENT DOCUMENTS

| | | | | |
|---|---|---|---|---|
| 7,059,873 | B2 * | 6/2006 | Johnescu | H01R 13/2435 439/444 |
| 9,099,819 | B2 * | 8/2015 | Hwang | H01R 13/648 |
| 9,172,161 | B2 | 10/2015 | Walden et al. | |
| 10,116,079 | B1 * | 10/2018 | Ju | H01R 13/2442 |
| 10,777,929 | B2 * | 9/2020 | Hwang | H01R 13/2442 |
| 10,886,655 | B2 * | 1/2021 | Hwang | H01R 13/2442 |
| 11,139,593 | B2 * | 10/2021 | Ho | H01R 43/20 |
| 11,152,732 | B2 * | 10/2021 | Ho | H01R 13/2457 |
| 11,196,197 | B1 * | 12/2021 | Wen | H01R 12/57 |
| 11,264,745 | B2 * | 3/2022 | Hwang | H01R 13/41 |
| 2020/0227840 | A1 | 7/2020 | Ho | |
| 2020/0227855 | A1 | 7/2020 | Ho | |
| 2021/0075178 | A1 * | 3/2021 | Hwang | H01R 43/20 |
| 2021/0184384 | A1 * | 6/2021 | Chen | H01R 13/405 |
| 2021/0184386 | A1 * | 6/2021 | Chen | H01R 13/24 |

* cited by examiner

ELECTRICAL CONNECTOR AND METHOD THEREOF MAKING THE SAME

BACKGROUND OF THE INVENTION

1. Field of the Invention

The present invention relates to a connector assembly and the manufacturing method thereof, and particularly to the connector having corresponding contacts with a fine pitch contact arrangement and assembled into the housing via a contact module pattern.

2. Description of Related Arts

As shown in US Patent Application Publication No. 2020/0227855, the electrical connector having a plurality of contacts with a strip connecting portion 241 at the bottom for connecting to a lower contact carrier 80, and a connecting portion 25 at an upper portion for connecting to an upper contact carrier 90. Anyhow, because of the side arms 242 of the conducting portion 24 around the strip connecting portion 242, the neighboring contacts 2 cannot be densely arranged with one another with a fine pitch arrangement wherein the contacts 2 are arranged corresponding to every other positioning holes defined in the lower contact carrier 80, thus precluding the miniaturization of the corresponding connector disadvantageously.

Therefore, an improvement to the electrical connector with a fine pitch arrangement of the corresponding contacts and an easy manufacturing method thereof, is desired.

SUMMARY OF THE INVENTION

To achieve the above object, an electrical connector includes an insulative housing, and plural rows of contact modules disposed in the housing. Each contact module includes a plurality of contacts integrally formed within an insulator/wafter which extends in a longitudinal direction. In each contact module, each contact includes a main body with opposite contacting arms on upper and lower sections wherein the contacts in the same contact carrier are originally linked with the neighboring contacts around lateral sides of the main body for insert-molding consideration, and the corresponding linking sections are removed for disconnecting the neighboring the contacts after insert-molding to form the final complete contact module. Each contact module is successively assembled downwardly, by a gripping tool, into the corresponding receiving channel in the housing. Each contacting arm forms a hole with two spaced beams by two sides of the hole. The contact may further optimally include a holding tab exposed in the hole and between the corresponding pair of beams so as to allow the gripping tool to be engaged thereon for assembling the contact module into the channel of the housing.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
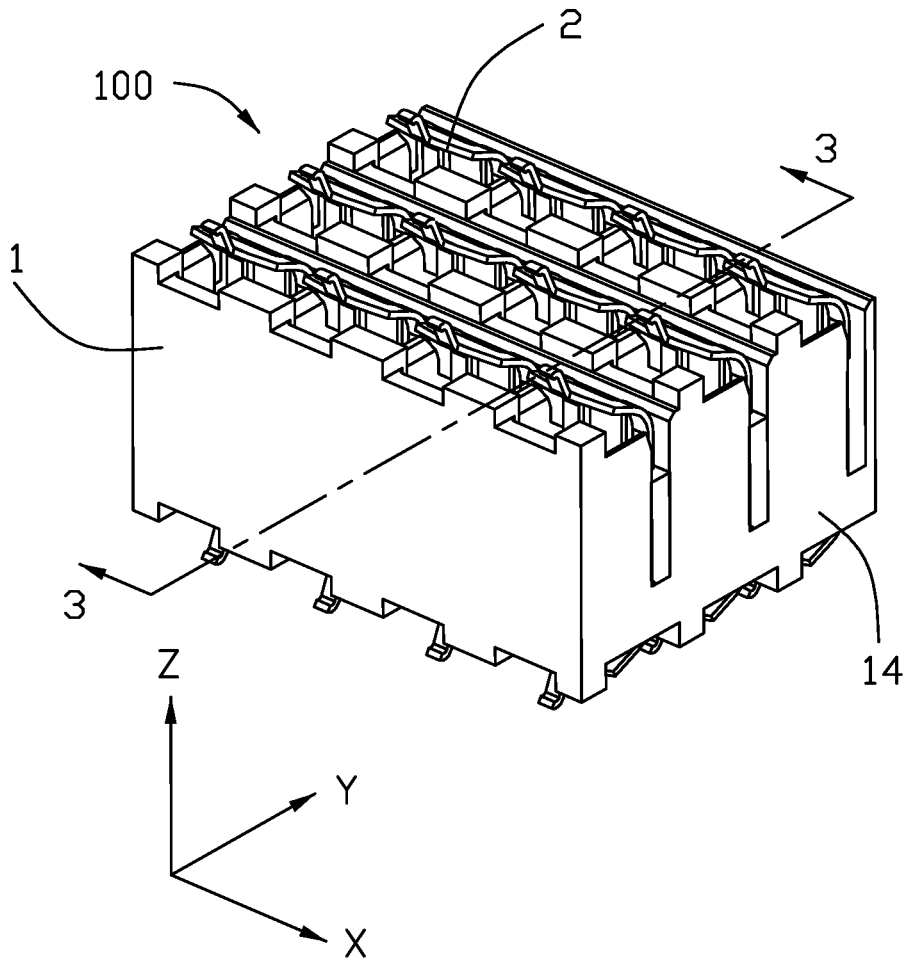
FIG. 1 is a perspective view of an electrical connector according to the invention.

Referring to FIGS. 1-15, an electrical connector 100 for mating with an electronic package (not shown), e.g., a chip, includes an insulative housing 1, and a plurality of contact modules 4 retained in the housing 1. Each contact module 4 includes a plurality of contacts 2 integrally formed within an insulator/wafer 3 via insert-molding. In this embodiment, direction X is a longitudinal direction, direction Y is a transverse direction, a direction Z is a vertical direction. All directions X, Y and Z are perpendicular to one another.

The hosing 1 includes an upper surface 11 and a lower surface 12 opposite to each other in the vertical direction Z, a pair of side surfaces 14 opposite to each other in the longitudinal direction, and a plurality of channels 13 extending along the longitudinal direction X and upwardly through the upper surface 11 in the vertical direction Z, and through the pair of side surfaces 14 in the longitudinal direction.

Figure 8:
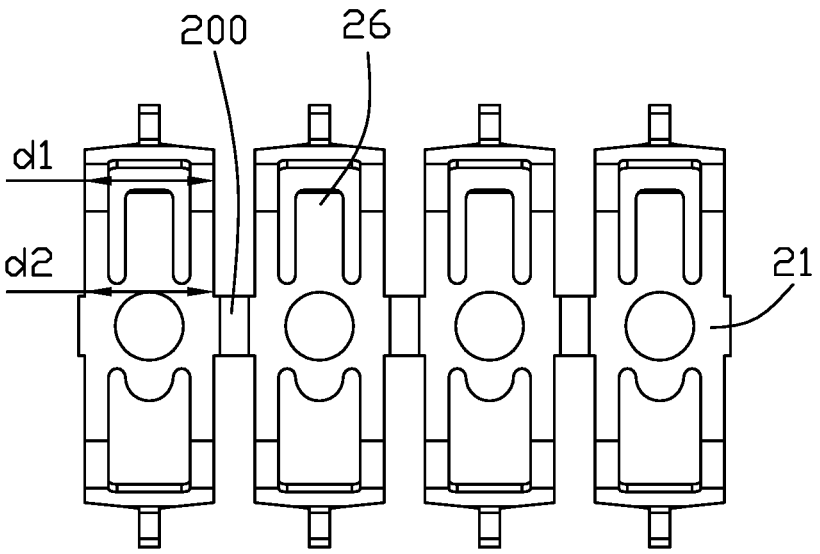
FIG. 8 is an elevational view of the contacts of the contact module of the electrical connector of FIG. 7 wherein the linking sections between the neighboring contacts are not removed.
Figure 9:
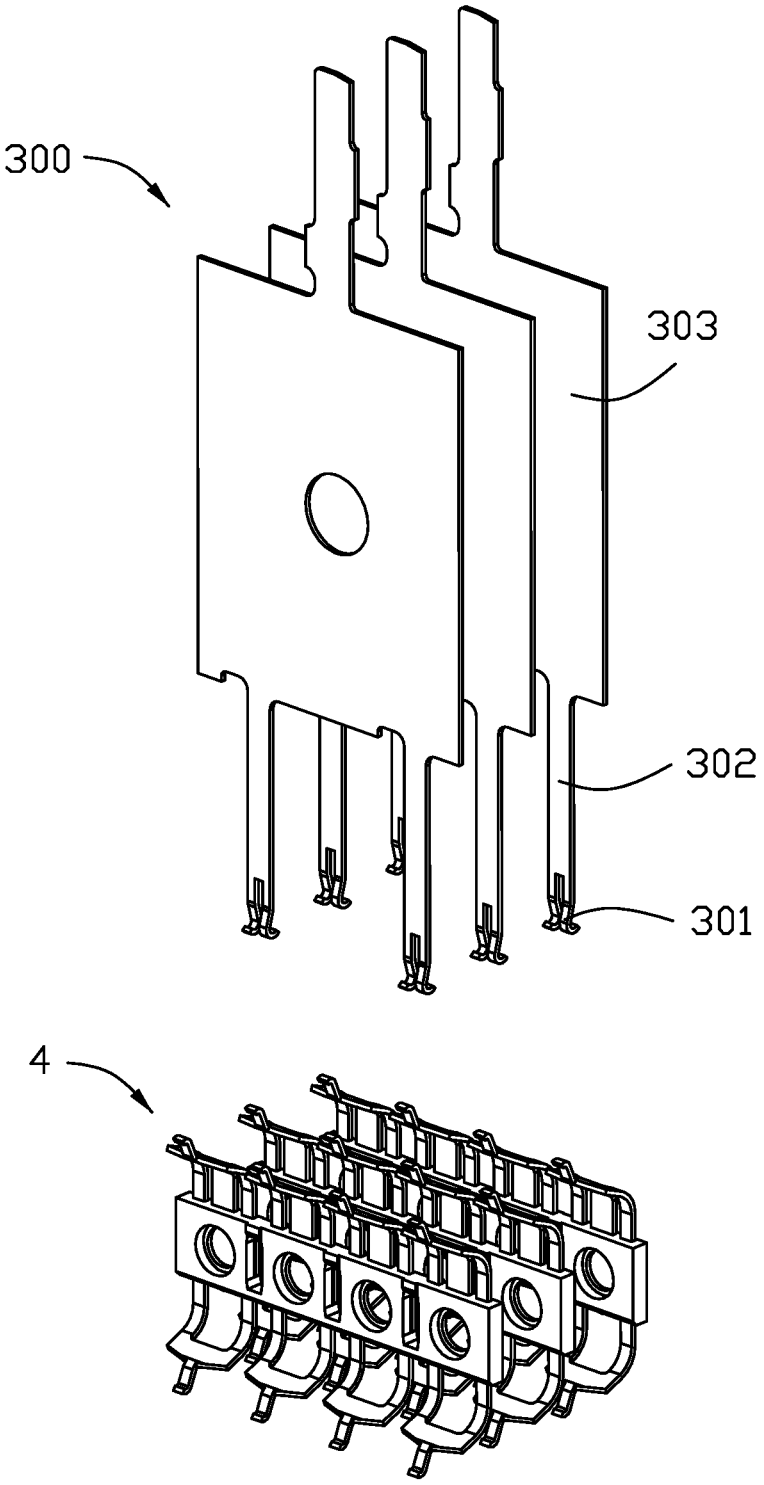
FIG. 9 is a perspective view showing the gripping tools positioned above the corresponding contact modules of the electrical connector of FIG. 4.
Figure 10:
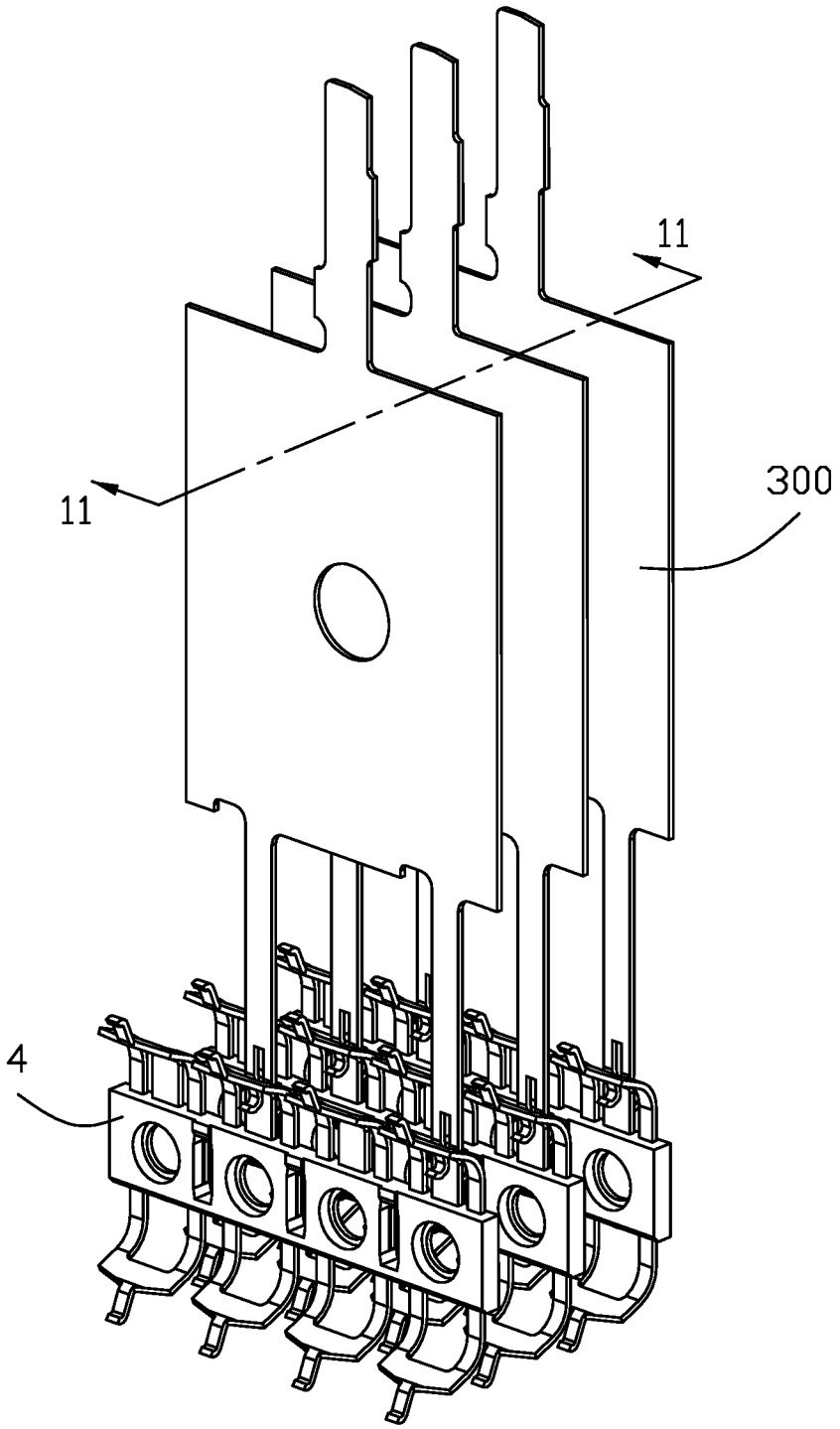
FIG. 10 is a perspective view showing the gripping tools engaging the corresponding contact modules of the electrical connector of FIG. 9.
Figure 11:
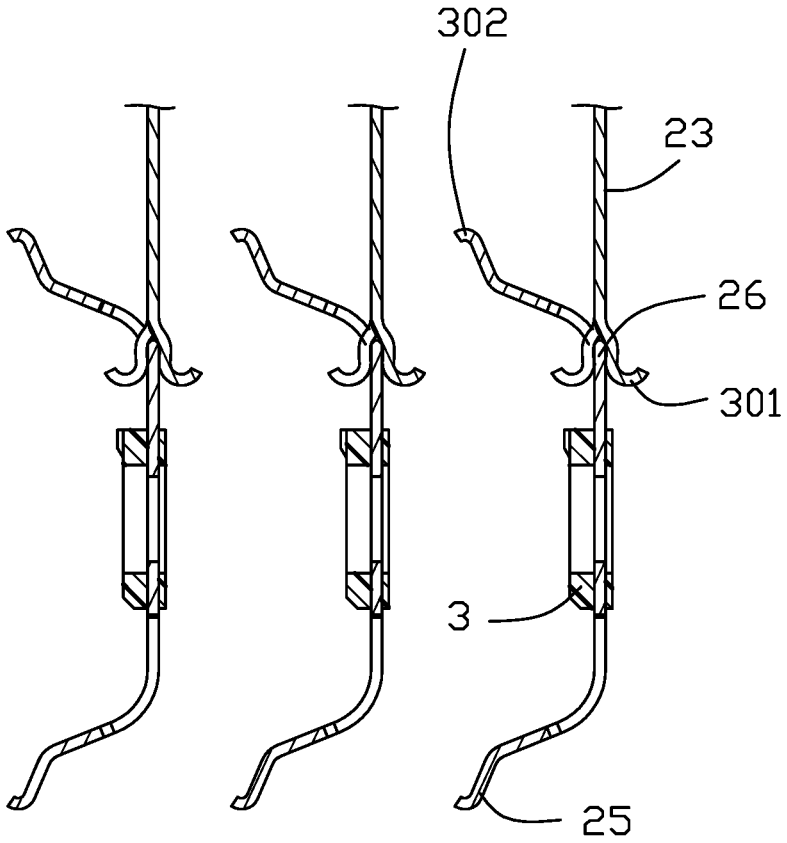
FIG. 11 is a side view showing the gripping tools engaging the corresponding contact modules of the electrical connector of FIG. 10.
Figure 12:
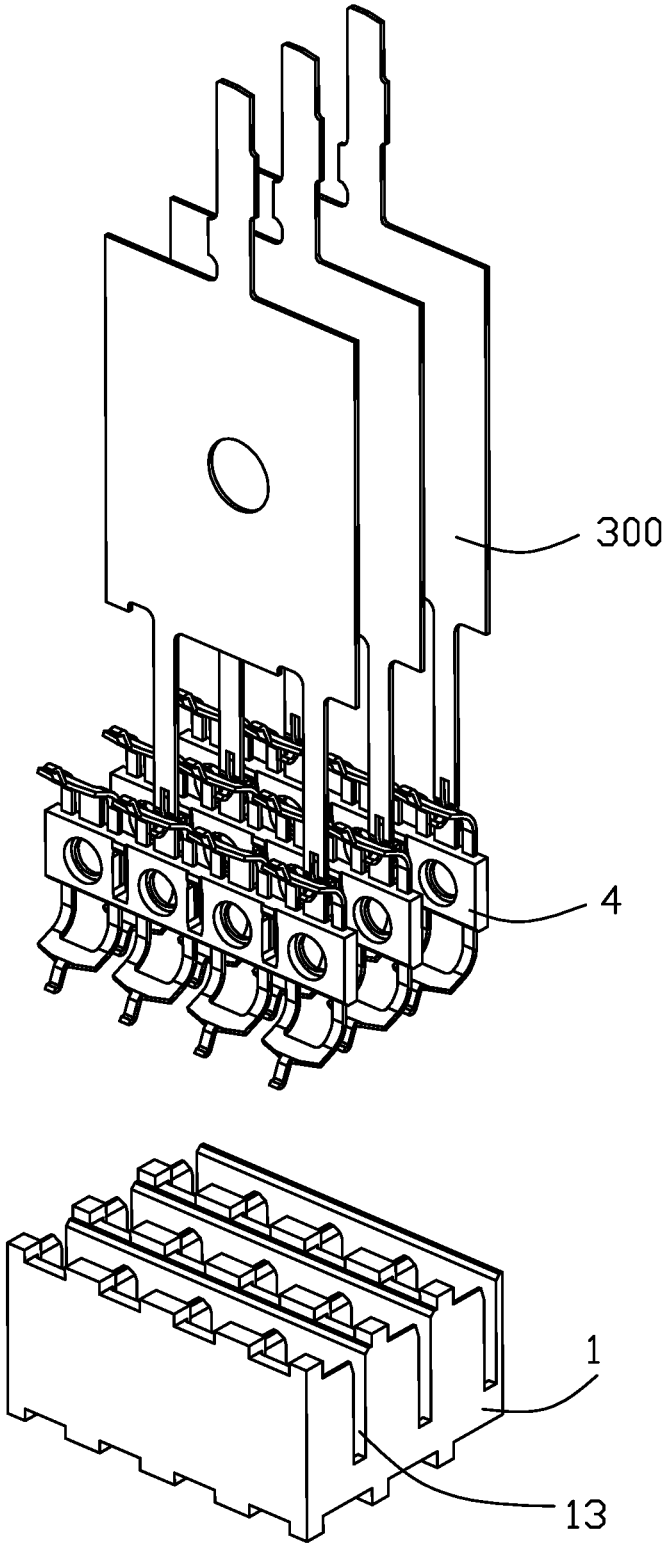
FIG. 12 is a perspective view showing the gripping tools retaining the corresponding contact modules for ready to assemble the contact modules into the corresponding channels in the housing of the electrical connector of FIG. 1.

The contact 2 is made by sheet metal and includes a planar main body 21, a first/upper spring arm 22 upwardly extending from an upper portion of the main body 21 with a first/upper contacting section 23 at a free end, a second/lower spring arm 24 downwardly extending from a lower portion of the main body 21 with a second/lower contacting section 25 at a free end. The first spring arm 22 defines a first opening 224 therein so as to form a pair of first and second beams 221, 222 located by two sides of the first opening 224 and merged together at the upper/first bridge 223. The first contacting section 23 extends upwardly from the first bridge 223. A holding tab 26 extending from an upper portion of the main body 21 into the opening 224 and between the pair of beams 221, 222. As shown in FIG. 8, along the longitudinal direction, the width d1 defined by the first spring arm 22 is similar to the width d2 defined by the main body 21. The contacts 2 of the same contact module 4 are made from a same metal sheet so as to have the linking carrier 200 between every adjacent two contacts 2 linked with the corresponding connecting sections/edges 27 of the lateral sides of the main bodies 21 thereof. The main body 21 forms an opening 211 for forming the contact module 4. The width of the first contacting section 23 is smaller than that of the holding tab 26.

Similar to the first spring arm 22, the second spring arm 24 forms a second opening 244 with a pair of beams 241, 242 by two side of the second opening 244, and merged together at the second bridge 243 from which the second contacting section 25 downwardly extends. Therefore, the first spring arm 21 and the second spring arm 22 are essentially symmetrically arranged with each other in the vertical direction. Notably, the distance d3 between the corresponding spring arms 22 or 24 of the neighboring contacts 2 is around 0.24 mm which is relatively tiny compared with the traditional design, thus increasing the coupling effect for better signal transmission advantageously.

Referring to FIGS. 4-7, in each contact module 4, the insulator 3 encloses the corresponding row of contacts 2. The insulator 3 forms a plurality of openings 41 aligned with the corresponding linking carriers 200 and a plurality of openings 42 aligned with the corresponding openings 211 in the transverse direction Y. Notably, the linking carriers 200 are removed from the contact module 4 after insert-molding for separating the neighboring contacts 2.

Figure 2:
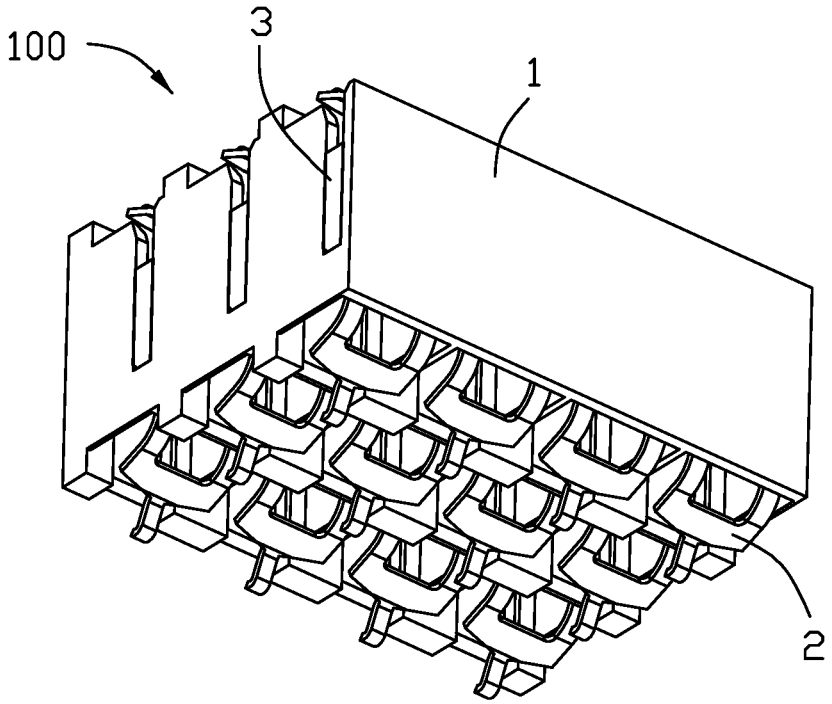
FIG. 2 is another perspective view of the electrical connector of FIG. 1.
Figure 3:
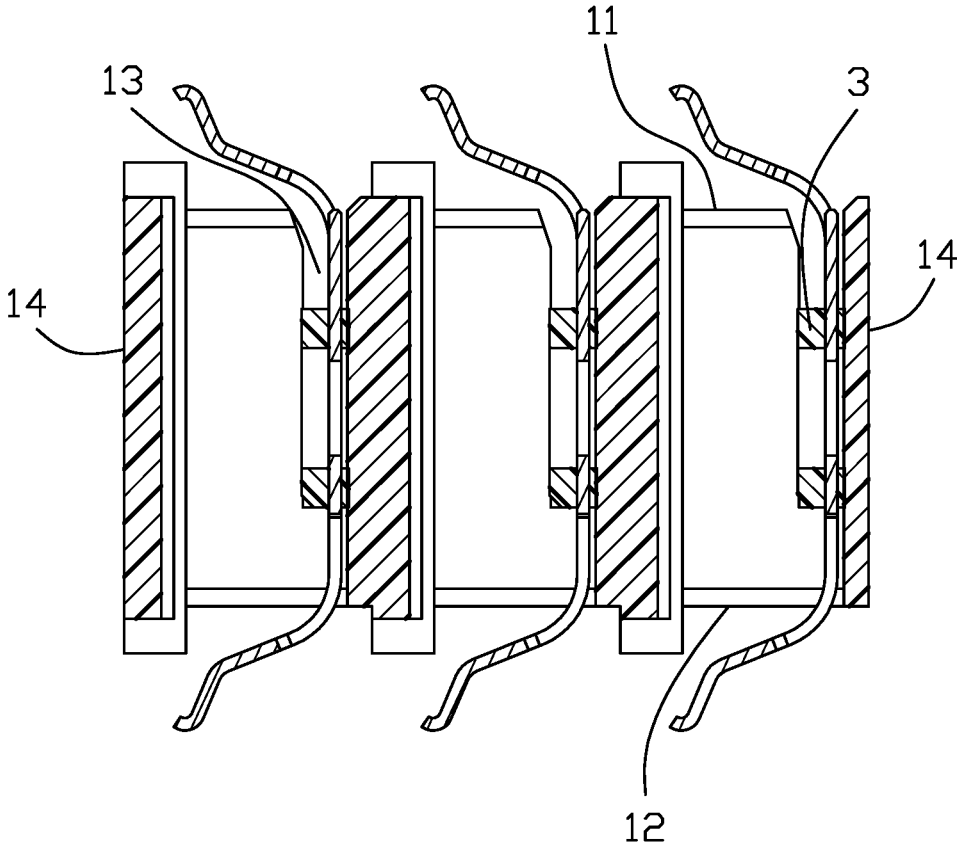
FIG. 3 is a cross-sectional view of the electrical connector of FIG. 1.
Figure 4:
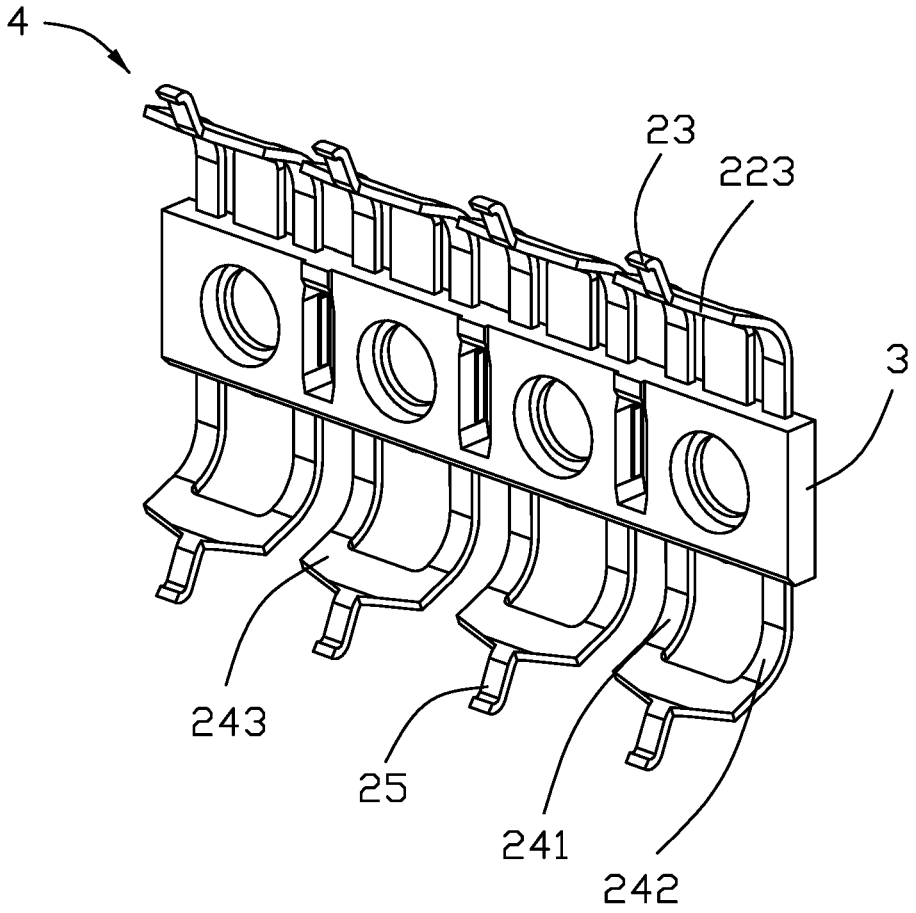
FIG. 4 is a perspective view of the contact module of the electrical connector of FIG. 1.
Figure 5:
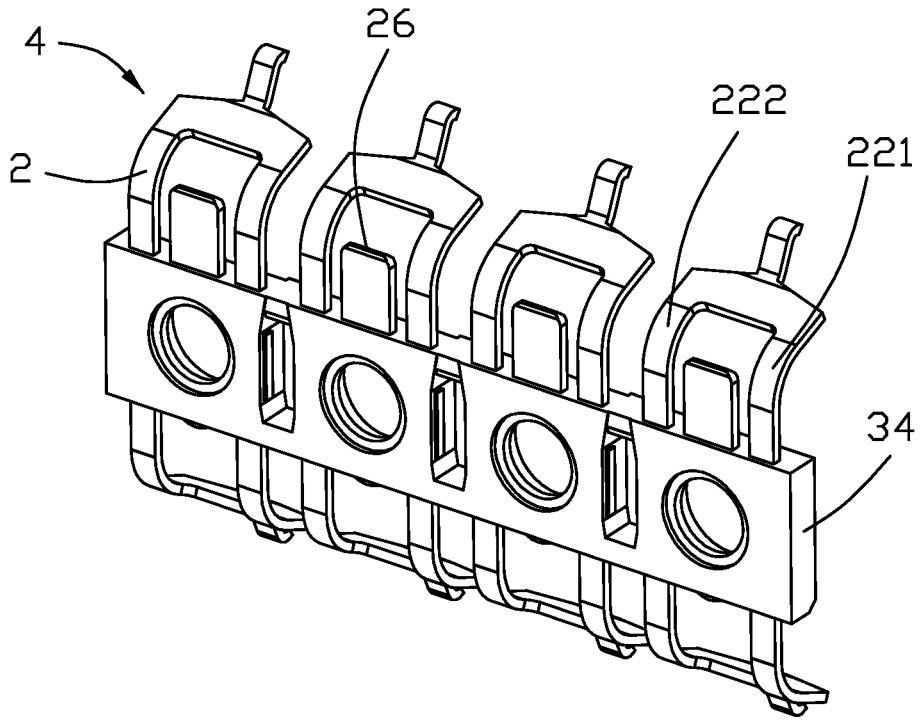
FIG. 5 is another perspective view of the contact module of the electrical connector of FIG. 4.
Figure 6:
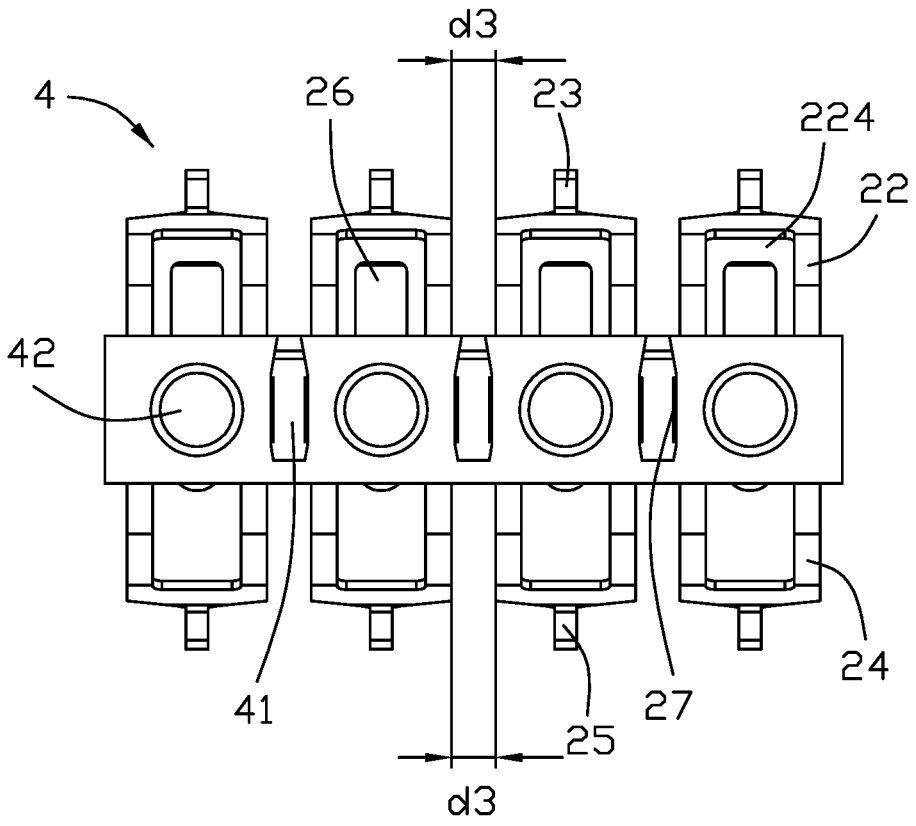
FIG. 6 is an elevational view of the contact module of the electrical connector of FIG. 5.
Figure 7:
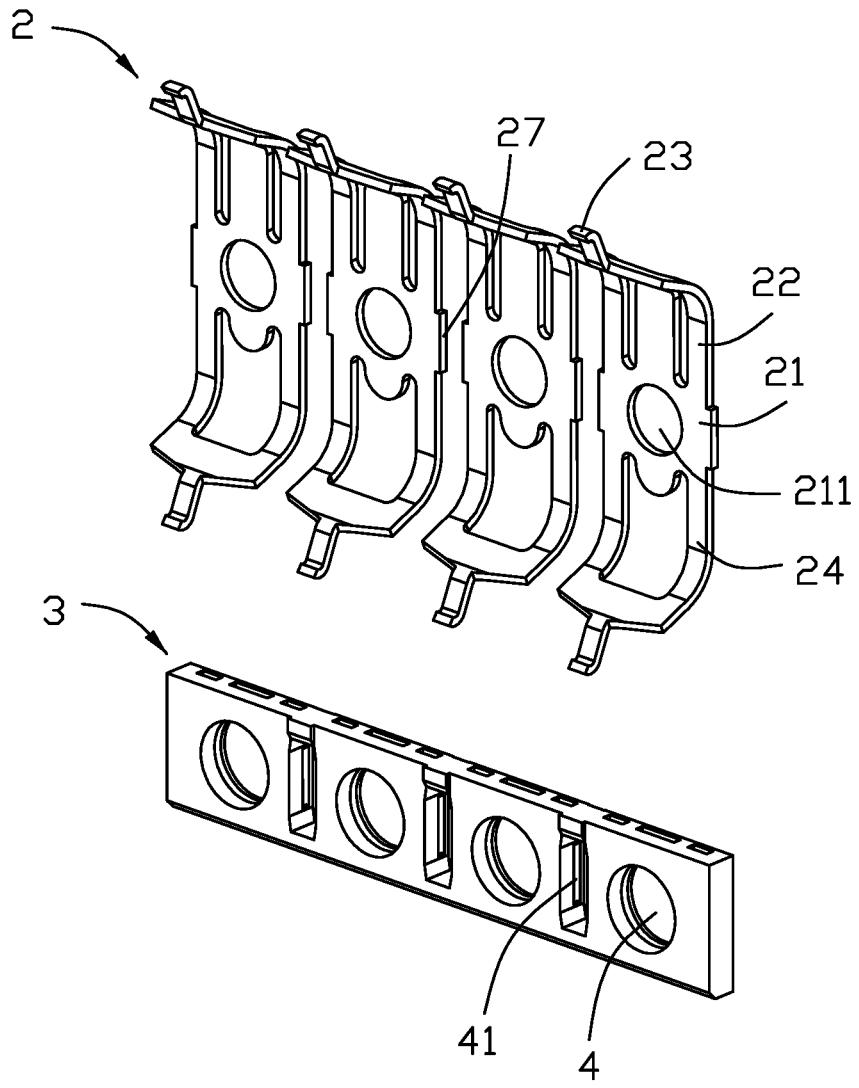
FIG. 7 is an exploded perspective view of the contact module of the electrical connector of FIG. 4.
Figure 13:
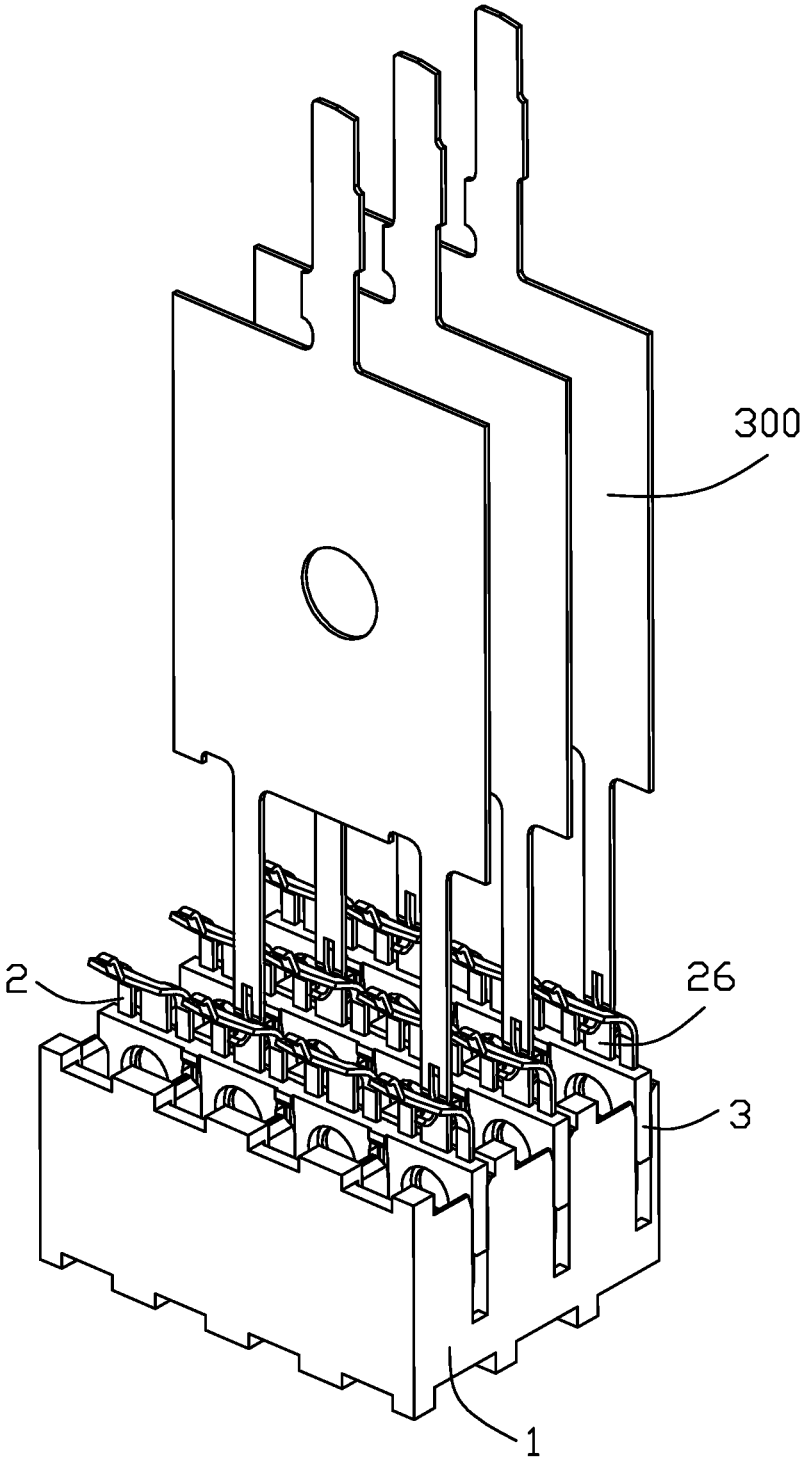
FIG. 13 is a perspective view showing the contact modules held by the corresponding gripping tools are assembled into the corresponding channels in the housing of the electrical connector of FIG. 12.
Figure 14:
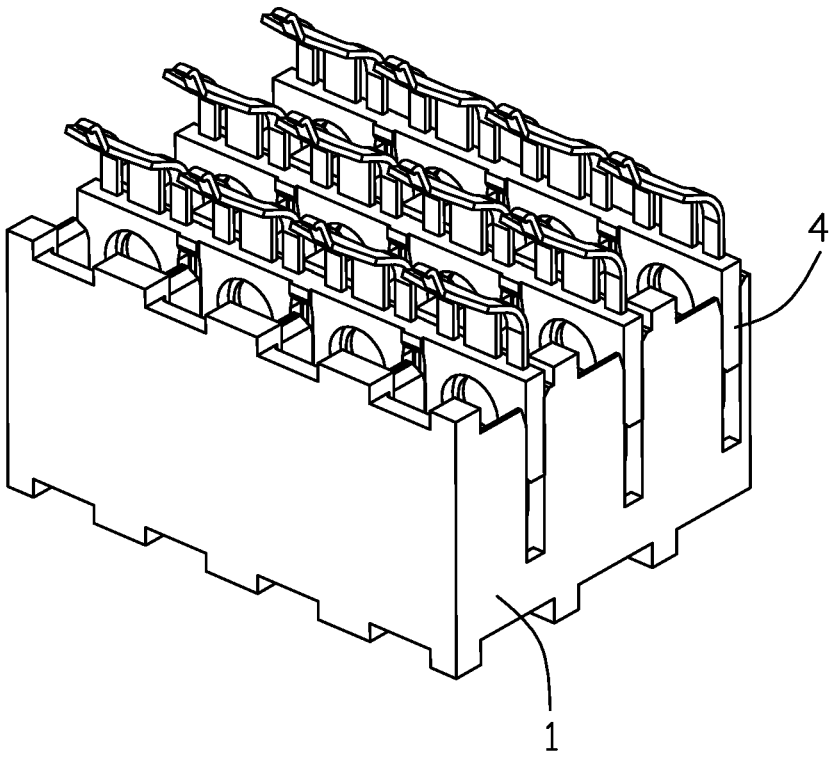
FIG. 14 is a perspective view showing the contact module are assembled into the corresponding channels in the housing of the electrical connector of FIG. 13 at an initial upper position, compared with the final lower position shown in FIG. 1.
Figure 15:
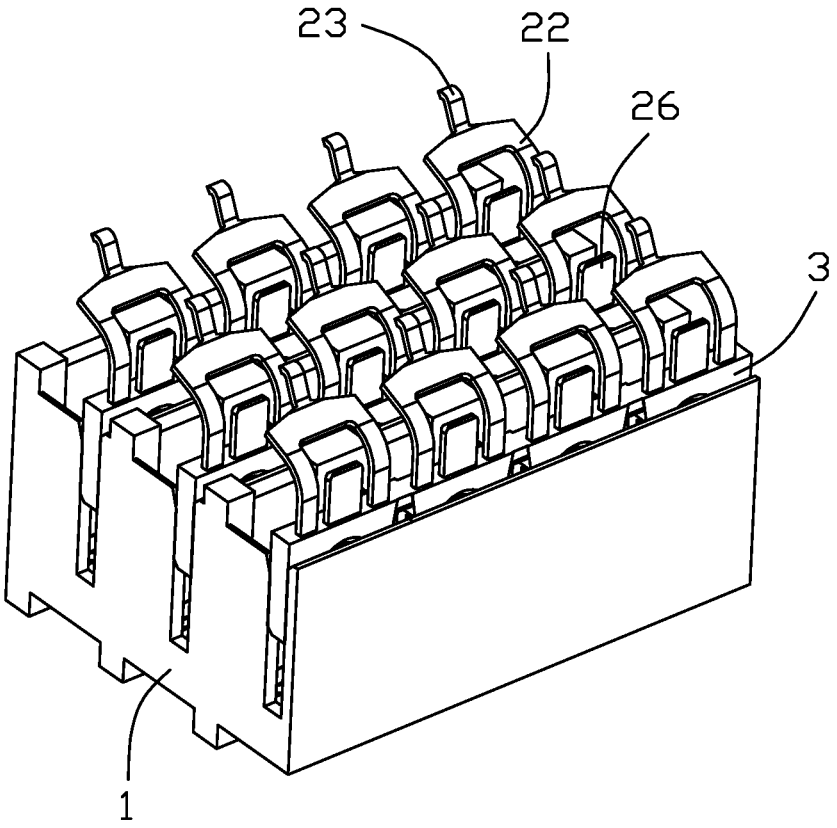
FIG. 15 is another perspective view showing the contact module are assembled into the corresponding channels in the housing of the electrical connector of FIG. 13 at the initial upper position.

Referring to FIGS. 9-15, the method of making the connector 100 includes the following steps as follows:

Step 1: providing an insulative housing 1 with opposite upper and lower surfaces 11, 12 in the vertical direction, and a plurality of channels 13 extending along the longitudinal direction;

Step 2: providing in one row a plurality of contacts each having a main body 21, a first spring arm 22 extending upwardly from the upper portion of the main body 21 with a first contacting section thereon, and a second spring arm 24 extending downwardly form the lower portion of the main body 21 with a second contacting section thereon, a plurality of linking carriers 200 linked between the corresponding main bodies 21 of the neighboring contacts 2, and a holding tab 26 forms around the upper portion of the main body 21;

Step 3: integrally forming the plurality of contacts within an insulator via an insert-molding process to form a contact module;

Step 4: punching out the linking carriers 200 from the contact module 4 via the corresponding openings 41 for separating the neighboring contacts 2 from each other;

Step 5: gripping the corresponding holding tabs 26 by the pair of clamping pieces 301 of a gripping tool 300, e.g., another carrier, wherein the gripping tool 300 includes a main part 303, a plurality of bars 302 extending downwardly from the main part 303 with the pair of clamping pieces 301 at the free end, and downwardly assembling the contact module 4 into the corresponding channel 13 from the upper side of the housing 1 until the contact module 4 is located at the initial/upper position as shown in FIGS. 13-15;

Step 6: using another pushing tool to downwardly press the corresponding holding tabs 26 until the contact module 4 is located at the final/lower position as shown in FIGS. 1-3 wherein the second contacting sections 25 are exposed under the lower surface 12 and the first contacting section 23 are exposed above the upper surface 11.

Compared with the traditional design, in the invention the contact module allows the stable and efficient assembling of the contacts into the housing. The holding tab allows the gripping tool to assemble the contact module into the housing. The pitch of the contacts in the same row may be reduced because the linking carrier 200 is linked to the lateral sides of the main body rather than to the bottom portion of the contact. In this embodiment, the gap/distance between the upper spring arms of the neighboring contact is smaller than one third of the width of the upper spring arm in the longitudinal direction so as to achieve the fine pitch arrangement of the contacts in each contact module.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing defining opposite upper and lower surfaces in a vertical direction and forming a plurality of channels extending along a longitudinal direction perpendicular to the vertical direction;

a plurality of contact modules disposed in the corresponding channels, respectively, each contact module includes one row of contacts integrally formed within an insulator via an insert-molding process, each contact including a main body and an upper spring arm upwardly extending therefrom with an upper contacting section at a free end of the upper spring arm, and a holding tab exposed upwardly above the insulator;

wherein the holding tab is configured to be gripped by a gripping tool for downwardly assembling the contact module into the corresponding channel.

2. The electrical connector as claimed in claim 1, wherein a linking carrier is laterally linked between main bodies of every adjacent two contacts, and insulator forms a plurality of openings aligned with the corresponding linking carriers in a transverse direction perpendicular to both the vertical direction and the longitudinal direction so as to remove the linking carriers from the contact module via said corresponding opening after the insert-molding process and before assembling the contact module into the channel.

3. The electrical connector as claimed in claim 1, wherein the upper spring arm forms an opening with a pair of beams by two sides of the opening, and the holding tab extends from an upper portion of the main body and into the opening.

4. The electrical connector as claimed in claim 1, wherein in the longitudinal direction, a width of the main body is essentially same with that of the main body.

5. The electrical connector as claimed in claim 4, wherein a gap between the upper spring arms of the neighboring contacts is smaller than one third of a width of the upper spring arm in the longitudinal direction.

6. The electrical connector as claimed in claim 5, wherein said gap is essentially 0.24 mm.

7. The electrical connector as claimed in claim 5, wherein a width of the holding tab is larger than the gap in the longitudinal direction.

8. The electrical connector as claimed in claim 1, wherein said channel extends through two opposite side surfaces of the housing in the longitudinal direction.

9. An electrical connector assembly comprising:

an electrical connector including:

an insulative housing defining opposite upper and lower surfaces in a vertical direction and forming a plurality of channels extending along a longitudinal direction perpendicular to the vertical direction;

a plurality of contact modules disposed in the corresponding channels, respectively, each contact module includes one row of contacts integrally formed within an insulator via an insert-molding process, each contact including a main body and an upper spring arm upwardly extending therefrom with an upper contacting section at a free end of the upper spring arm, and a holding tab exposed upwardly above the insulator; and a gripping tool grips the holding tab for downwardly assembling the contact module into the corresponding channel.

10. The electrical connector assembly as claimed in claim 9, wherein the upper spring arm forms an opening in which the holding tab is located.

11. The electrical connector assembly as claimed in claim 10, wherein the gripping tool includes a main part and a plurality of bars extending therefrom each with a corresponding pair of clamping pieces sandwiching the corresponding holding tab in a transverse direction perpendicular to both the vertical direction and the longitudinal direction.

12. The electrical connector assembly as claimed in claim 9, wherein a linking carrier is laterally linked between main bodies of every adjacent two contacts, and insulator forms a plurality of openings aligned with the corresponding linking carriers in a transverse direction perpendicular to both the vertical direction and the longitudinal direction so as to remove the linking carriers from the contact module by punching via said corresponding opening after the insert-molding process and before assembling the contact module into the channel.

13. The electrical connector as claimed in claim 9, wherein in the longitudinal direction, a width of the main body is essentially same with that of the main body.

14. The electrical connector as claimed in claim 13, wherein a gap between the upper spring arms of the neighboring contacts is smaller than one third of a width of the upper spring arm in the longitudinal direction.

15. The electrical connector as claimed in claim 14, wherein a width of the holding tab is larger than the gap in the longitudinal direction.

16. A method of making an electrical connector comprising steps of:

providing an insulative housing with a plurality of channels extending in a longitudinal direction;

providing a plurality of contact modules wherein each contact module includes one row of contacts integrally formed, via an insert-molding process, within an elongated insulator extending in the longitudinal direction, and each contact includes a holding tab extending upwardly above the insulator in a vertical direction perpendicular to the longitudinal direction; and providing at least a gripping tool with plural gripping parts to respectively hold the corresponding holding tabs of the corresponding contact module; and downwardly assembling the at least one contact module into the corresponding channel.

17. The method as claimed in claim 16, wherein the at least one gripping tool includes more than two gripping tools to hold more than two contact modules at the same time.

18. The method as claimed in claim 16, wherein in each contact module, the main bodies of the neighboring contacts are originally laterally linked with corresponding linking carriers, and the insulator forms a plurality of openings in aligned with the corresponding linking carriers in a transverse direction perpendicular to both the longitudinal direction and the vertical direction so as to remove the corresponding linking carriers by punching through the corresponding openings after the insert-molding process and before assembling the contact module into the channel.

19. The method as claim 16, wherein the contact module is initially downwardly into the corresponding channel at an initial upper position by the gripping tool, and successively downwardly moved to a final lower position by another pressing tool.

20. The method as claimed in claim 16, wherein the main body of each contact forms an opening, and the insulator forms a plurality of holes in alignment with the corresponding openings in a transverse direction perpendicular to both the longitudinal direction and the vertical direction.

* * * * *